US007681965B2

(12) United States Patent
Brown et al.

(10) Patent No.: US 7,681,965 B2
(45) **Date of Patent: *Mar. 23, 2010**

(54) IMAGING APPARATUS HAVING A PROGRAMMABLE THROUGHPUT RATE

(75) Inventors: Thomas Daniel Brown, Frankfort, KY (US); Michael Duane Donovan, Lexington, KY (US); Tommy Otis Lowe, Lexington, KY (US); Daniel Scott Powell, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/870,963

(22) Filed: Oct. 11, 2007

(65) Prior Publication Data

US 2008/0030777 A1 Feb. 7, 2008

Related U.S. Application Data

(63) Continuation of application No. 10/919,167, filed on Aug. 16, 2004, now Pat. No. 7,344,212.

(51) Int. Cl.
*B41J 29/38* (2006.01)
*B41J 2/175* (2006.01)
*G03G 15/00* (2006.01)

(52) U.S. Cl. ..... 347/5; 347/86; 399/75; 358/1.13

(58) Field of Classification Search ..... 347/5
See application file for complete search history.

(56) References Cited

U.S. PATENT DOCUMENTS 5,137,379 A 8/1992 Ukai et al.
5,835,817 A 11/1998 Bullock et al.
6,015,207 A 1/2000 Winter et al.
6,040,917 A 3/2000 Campbell et al.
6,065,824 A 5/2000 Bullock et al.
6,104,496 A 8/2000 Minowa et al.
6,113,213 A 9/2000 Hosaka
6,116,710 A * 9/2000 Tajika et al. ..... 347/14
6,116,716 A * 9/2000 Tajika et al. ..... 347/19
6,145,950 A 11/2000 Ohtsuka et al.
6,189,993 B1 2/2001 Mantell
6,252,672 B1 6/2001 Sugawara et al.
6,290,321 B1 9/2001 Murray et al.
6,352,327 B1 3/2002 Yano et al.
6,402,284 B1 6/2002 Merz
6,460,962 B1 10/2002 Dietl et al.
6,467,869 B1 10/2002 Merz et al.
6,471,325 B2 10/2002 Abe
6,476,928 B1 11/2002 Barbour et al.
6,478,399 B1 11/2002 Mitsuzawa et al.
6,480,292 B1 11/2002 Sugiyama
6,487,376 B1 * 11/2002 Wang et al. ..... 399/12
6,522,348 B1 2/2003 Brot et al.
6,585,345 B2 7/2003 Kosugi
6,619,789 B2 9/2003 Childers et al.
6,802,586 B2 * 10/2004 Forman ..... 347/19

(Continued)

*Primary Examiner*—Matthew Luu
*Assistant Examiner*—Shelby Fidler

(57) ABSTRACT

An imaging apparatus includes a print engine for printing on a print medium. A device is communicatively coupled with the print engine. The device is programmed to set a throughput rate for the print engine. A controller reads the device, and operates the print engine at the throughput rate designated by the device.

13 Claims, 7 Drawing Sheets

U.S. PATENT DOCUMENTS

| | | | | |
|---|---|---|---|---|
| 7,077,311 | B1 * | 7/2006 | Conklin et al. | 347/19 |
| 7,123,367 | B1 | 10/2006 | Kanaya et al. | |
| 7,603,048 | B2 * | 10/2009 | Hasegawa | 399/13 |
| 2002/0105565 | A1 | 8/2002 | Suda et al. | |
| 2002/0113835 | A1 | 8/2002 | Pan et al. | |
| 2002/0122204 | A1 * | 9/2002 | Van Der Meijs | 358/1.15 |
| 2002/0135809 | A1 | 9/2002 | Lodge | |
| 2002/0181002 | A1 * | 12/2002 | Leyva | 358/1.13 |
| 2002/0191998 | A1 * | 12/2002 | Cremon et al. | 400/76 |
| 2003/0007027 | A1 | 1/2003 | Saruta | |
| 2003/0016389 | A1 | 1/2003 | Miyaguchi et al. | |
| 2003/0081253 | A1 | 5/2003 | Sekiguchi et al. | |
| 2003/0142179 | A1 | 7/2003 | Kearns et al. | |
| 2004/0021720 | A1 | 2/2004 | Abello | |
| 2005/0157002 | A1 * | 7/2005 | Silverbrook | 347/40 |

* cited by examiner

IMAGING APPARATUS HAVING A PROGRAMMABLE THROUGHPUT RATE

CROSS REFERENCE TO RELATED APPLICATIONS

This is a continuation of U.S. patent application Ser. No. 10/919,167, entitled "IMAGING APPARATUS HAVING A PROGRAMMABLE THROUGHPUT RATE", filed Aug. 16, 2004 now U.S. Pat. No. 7,344,212.

BACKGROUND OF THE INVENTION

1. Field of the Invention

The present invention relates to an imaging apparatus, and, more particularly, to an imaging apparatus having a programmable throughput rate.

2. Description of the Related Art

An imaging apparatus, such as an ink jet printer, has a rated throughput rate that is based, for example, on the number of pages that may be printed in a given time frame. For example, such an imaging apparatus may be rated in terms of the number of printed pages per minute.

A user may acquire an imaging apparatus having a particular throughput rate based on, for example, the user's printing speed requirements and/or the affordability of the imaging apparatus. However, prior to the imaging apparatus reaching the end of its useful life, the printing needs or financial situation of the user may have changed. In the past, the user would then be faced with the need to purchase a new printer, and likely would discard the previous printer, or relegate it to disuse.

What is needed in the art is an imaging apparatus having a programmable throughput rate.

SUMMARY OF THE INVENTION

The present invention provides an imaging apparatus having a programmable throughput rate.

The present invention, in one form thereof, is directed to an imaging apparatus including a print engine for printing on a print medium. A device is communicatively coupled with the print engine. The device is programmed to set a throughput rate for the print engine. A controller reads the device, and operates the print engine at the throughput rate designated by the device.

The present invention, in another form thereof, is directed to a method of configuring an imaging apparatus having a print engine. The method includes installing a supply item in the print engine, the supply item including a memory containing throughput data for setting a throughput rate of the imaging apparatus; reading the memory of the supply item to retrieve the throughput data; and setting the throughput rate of the imaging apparatus based on the throughput data retrieved from the supply item.

An advantage of the present invention is the ability to define a throughput rate for a particular model or class of imaging apparatus based, for example, on the supply item designated for use with the imaging apparatus.

Another advantage is that a customer may perform an upgrade of the throughput capabilities of an imaging apparatus, such as for example, through the purchase of a particular supply item of a plurality of supply items available for use with the imaging apparatus.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
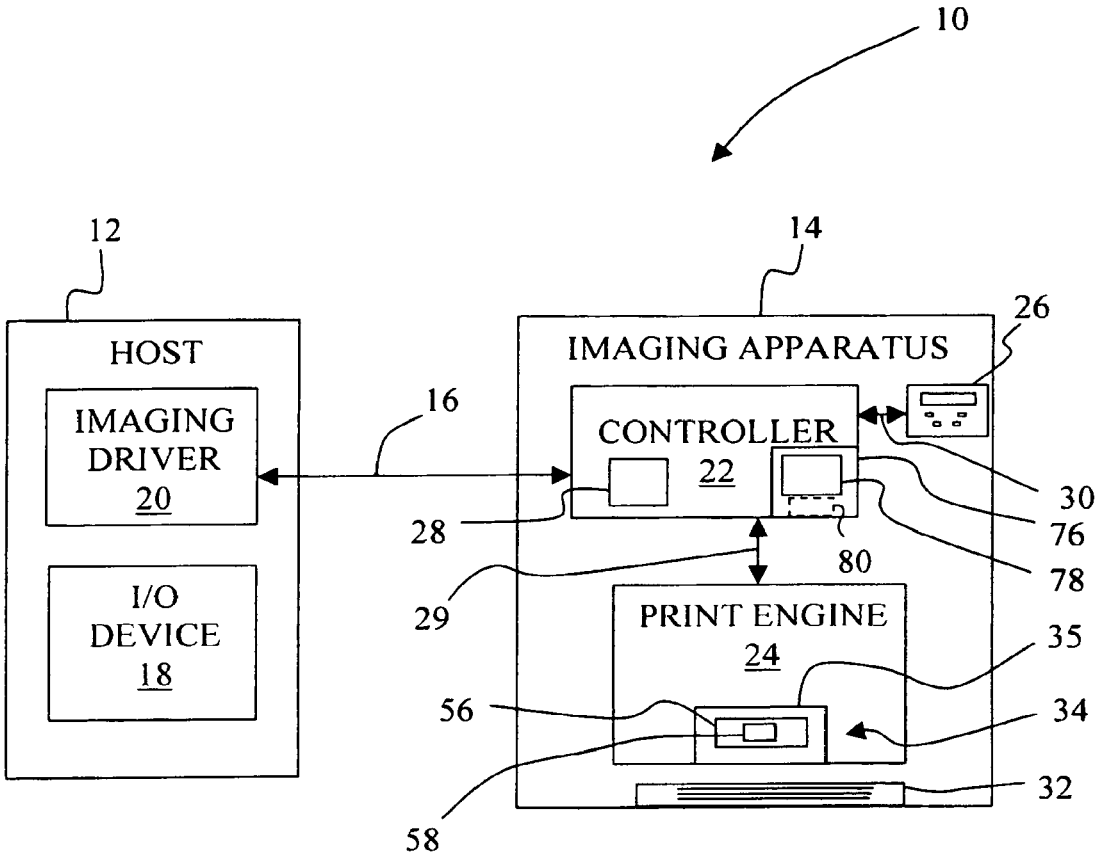
FIG. 1 is a diagrammatic representation of an imaging system embodying the present invention.

Referring now to the drawings, and particularly to FIG. 1, there is shown a diagrammatic depiction of an imaging system 10 embodying the present invention. Imaging system 10 may include a host 12 and an imaging apparatus 14, or alternatively, imaging system 10 may be a standalone system not attached to a host.

Host 12, which may be optional, may be communicatively coupled to imaging apparatus 14 via a communications link 16. Communications link 16 may be established, for example, by a direct cable connection, wireless connection or by a network connection such as for example an Ethernet local area network (LAN).

In embodiments including host 12, host 12 may be, for example, a personal computer including an input/output (I/O) device 18, such as keyboard and display monitor. Host 12 further includes a processor, input/output (I/O) interfaces, memory, such as RAM, ROM, NVRAM, and may include a mass data storage device, such as a hard drive, CD-ROM and/or DVD units. During operation, host 12 includes in its memory a software program including program instructions that function as an imaging driver 20, e.g., printer driver software, for imaging apparatus 14. Imaging driver 20 facilitates communication between host 12 and imaging apparatus 14, and may provide formatted print data to imaging apparatus 14.

Imaging apparatus 14 includes a controller 22, a print engine 24 and a user interface 26. Imaging apparatus 14 may be, for example, a printer or a multifunction unit. Such a printer may be, for example, an ink jet printer having an ink jet print engine, or an electrophotographic (e.g., laser) printer having an electrophotographic (EP) print engine. Such a multifunction unit may include an ink jet print engine and/or an EP print engine, and is configured to perform standalone functions, such as copying or facsimile receipt and transmission, or may be connected to host 12 via communications link 16 to facilitate a printing function.

Controller 22 includes a processor unit, a memory 28 and associated interface circuitry, and may be formed as an Application Specific Integrated Circuit (ASIC). Controller 22 communicates with print engine 24 via a communications link 29. Controller 22 communicates with user interface 26 via a communications link 30. Communications links 29 and 30 may be established, for example, by using standard electrical cabling or bus structures, or by wireless connection.

In the context of the examples for imaging apparatus 14 given above, print engine 24 is configured to form an image, e.g., text and/or graphics, on a print medium 32, such as a sheet of paper, transparency or fabric. In embodiments including host 12, imaging driver 20 is in communication with controller 22 of imaging apparatus 14 via communications link 16, and may provide formatted print data to imaging apparatus 14, and more particularly, to print engine 24. Alternatively, however, all or a portion of imaging driver 20 may be incorporated into controller 22 of imaging apparatus 14. Likewise, all or a portion of controller 22 may be incorporated into host 12.

Associated with imaging apparatus 14 is at least one supply item 34, such as for example an ink jet printhead cartridge or an EP cartridge. Supply item 34 is received into print engine 24. Supply item 34 includes an imaging substance reservoir 35 for holding a supply of imaging substance, such as one or more colors of ink or toner, e.g., monochrome (black), cyan, magenta and/or yellow, and/or diluted forms thereof. For example, in embodiments where print engine 24 is an ink jet print engine, then the imaging substance is ink. In embodiments wherein print engine 24 is an EP print engine, then the imaging substance is toner, which may be in dry or liquid form.

Figure 2:
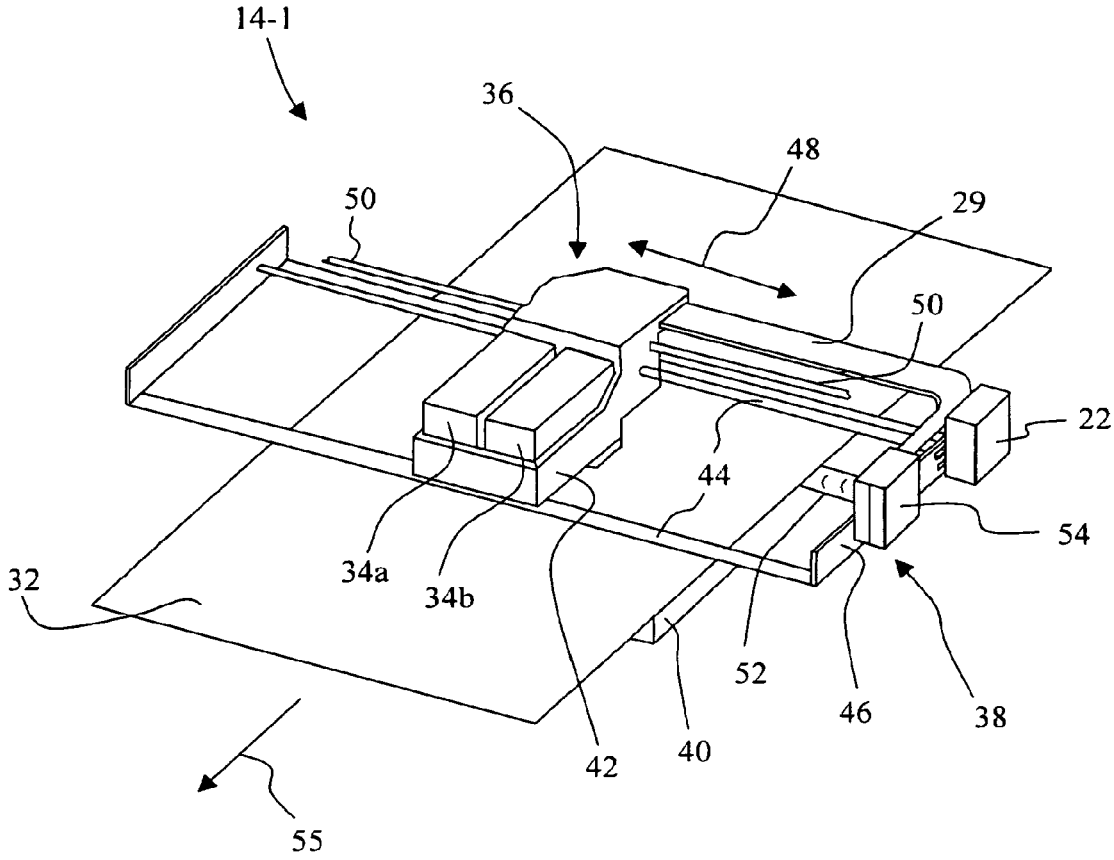
FIG. 2 is a diagrammatic representation of an imaging apparatus of the imaging system of FIG. 1, in the form of an ink jet printer.

It is contemplated that imaging apparatus 14 may simultaneously accommodate multiple supply items 34. For example, FIG. 2 shows an exemplary embodiment of imaging apparatus 14 in the form of an ink jet printer 14-1. Ink jet printer 14-1 includes a printhead carrier system 36, a feed roller unit 38, and a mid-frame 40. Controller 22 is electrically coupled to each of printhead carrier system 36 and feed roller unit 38 via communications link 29. Ink jet printer 14-1 may serve as the printing mechanism in a multi-function apparatus, such as an apparatus capable of performing copying and faxing, in addition to printing.

Printhead carrier system 36 includes a printhead carrier 42 that carries, for example, one or more printhead cartridges, such as for example, a monochrome ink jet printhead cartridge 34*a* and/or a color ink jet printhead cartridge 34*b*, that is mounted thereto. Monochrome ink jet printhead cartridge 34*a* may include a monochrome ink reservoir provided in fluid communication with a monochrome ink jet printhead. Color ink jet printhead cartridge 34*b* may include a color ink reservoir provided in fluid communication with a color ink jet printhead. Alternatively, the ink reservoirs may be located off-carrier, and coupled to the respective ink jet printheads via respective fluid conduits. Also, alternatively, monochrome ink jet printhead cartridge 34*a* may be replaced by a photo ink jet printhead cartridge that may include additional ink colors and/or formulations.

Printhead carrier 42 is guided by a pair of guide members 44. Either, or both, of guide members 44 may be, for example, a guide rod, or a guide tab formed integral with a frame portion 46 of ink jet printer 14-1. The axes of guide members 44 define a bi-directional scanning path 48 of printhead carrier 42. Printhead carrier 42 is connected to a carrier transport belt 50 that is driven by a carrier motor (not shown). One skilled in the art will recognize that other drive coupling arrangements could be substituted for the example given, such as for example, a worm gear drive.

Feed roller unit 38 includes a feed roller 52 and a drive unit 54. Upon receiving a command from controller 22, drive unit 54 rotates feed roller 52 to transport the print medium 32 in a sheet feed direction 55 during a printing operation. During the printing operation, print medium 32 may be supported by mid-frame 40. Controller 22 selectively actuates the printheads of monochrome printhead cartridge 34*a* and/or a color printhead cartridge 34*b* to form an image on print medium 32.

Figure 3:
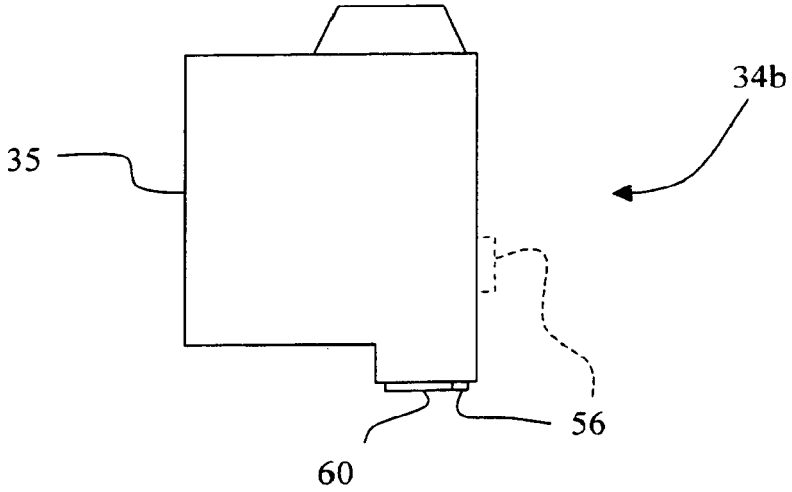
FIG. 3 is a diagrammatic representation of an exemplary supply item configured in accordance with the present invention.

Referring now to FIGS. 1 and 3, each supply item 34 may respectively include an electronic circuit 56, including a memory 58 and interface circuitry for facilitating communications with controller 22. FIG. 3 shows an exemplary embodiment of supply item 34 in the form of color ink jet printhead cartridge 34*b*, wherein electronic circuit 56 may be formed as a part of the silicon on which a printhead 60 is formed. As an alternative to including electronic circuit 56 on the silicon of printhead 60, electronic circuit 56 may be separately affixed to supply item 34, such as by attachment to imaging substance reservoir 35, as shown by dashed lines.

Figure 4:
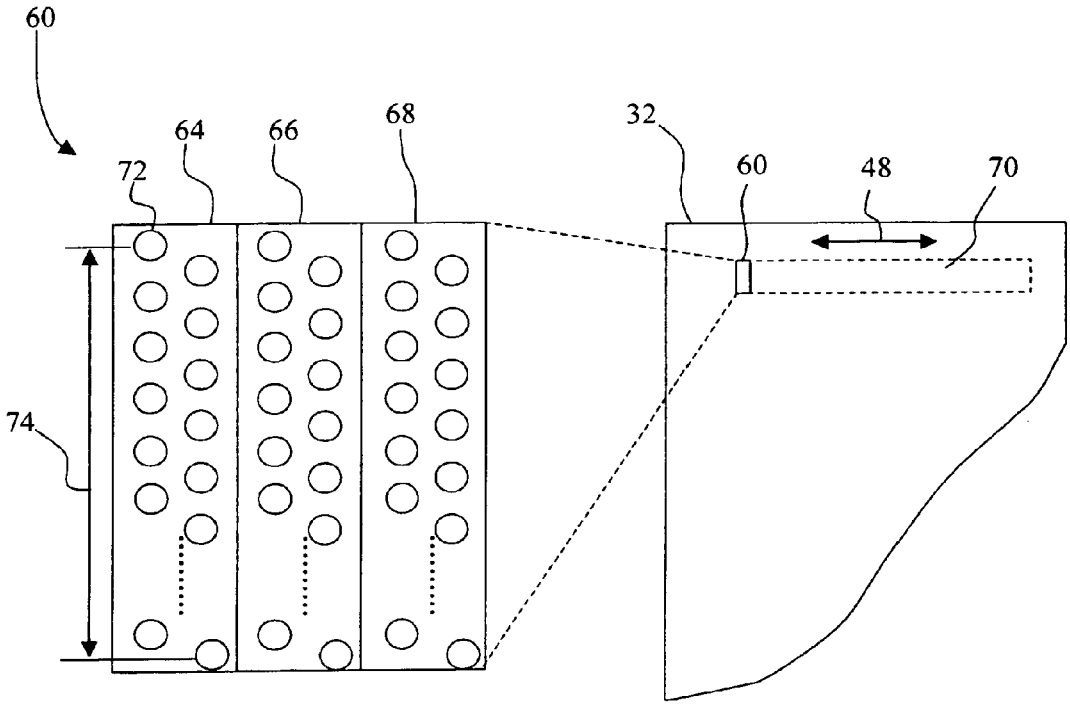
FIG. 4 is a diagrammatic representation of an ink jet printhead and an associated exemplary printing swath.

Referring now to FIG. 4, printhead 60, as a color printhead, may include a cyan nozzle array 64, a magenta nozzle array 66 and yellow nozzle array 68, for respectively ejecting cyan (C) ink, magenta (M) ink and yellow (Y) ink. Alternatively, one of more of the cyan, magenta and yellow inks may be a dilute ink. The term, dilute, is used for convenience to refer to a ink that does not have a luminance intensity as high as that associated with a corresponding full strength ink of substantially the same chroma, and thus, such dilute inks may be, for example, either dye based or pigment based. Those skilled in the art will recognize that the order of the nozzle arrays is not critical to the present invention, and that other color combinations may be used without departing from the scope of the present invention. Where printhead 60 includes full strength cyan (C), magenta (M) and black (K) nozzle arrays 64, 66, 68, a second printhead that includes dilute cyan (c), dilute magenta (m) and black (K) nozzle arrays may also be loaded in printhead carrier 42 to facilitate six-color printing, as may often be the case when printing in a photographic quality mode with imaging apparatus 14.

Printhead carrier 42 is controlled by controller 22 to move printhead 60 in a reciprocating manner along bi-directional scan path 48. Each left to right, or right to left movement of printhead carrier 42 along bi-directional scan path 48 over print medium 32 will be referred to herein as a pass. The area traced by printhead 60 over print medium 32 for a given pass will be referred to herein as a swath, such as for example, swath 70 as shown in FIG. 4.

In the exemplary nozzle configuration for ink jet printhead 60 shown in FIG. 4, each of nozzle arrays 64, 66 and 68 include a plurality of ink jetting nozzles 72. As within a particular nozzle array, or as from one nozzle array in comparison to another, the nozzle size may be, but need not be, the same size. A swath height 74 of swath 70 corresponds to the distance between the uppermost and lowermost of the available nozzles of printhead 60.

In accordance with one aspect of the present invention, a device 76, which may include a memory 78, and optionally a hardware component 80, (see FIG. 1) is communicatively coupled with print engine 24. Device 76 may be, for example, formed integral with controller 22, or may be separate. Device 76 is programmable to set a throughput rate for print engine 24. For example, controller 22 may read device 76, and in turn control the operation of print engine 24 at the throughput rate designated by device 76.

Figure 5:
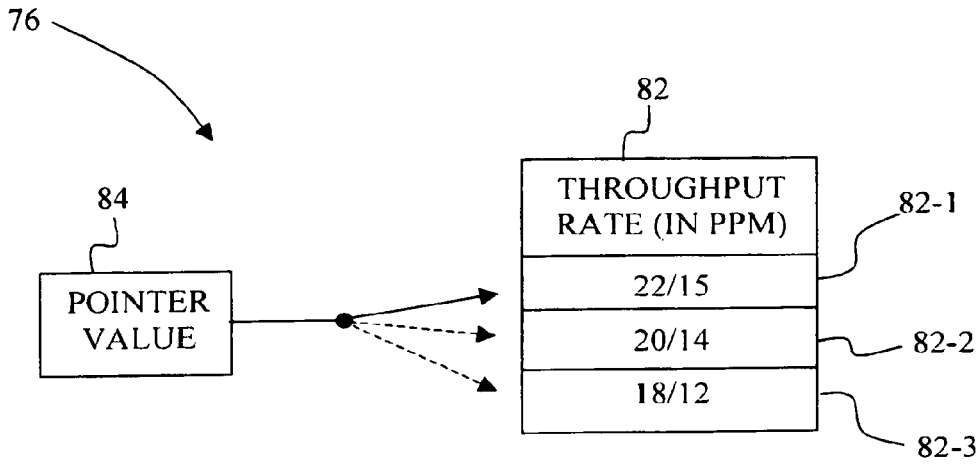
FIG. 5 is a diagrammatic representation of an exemplary threshold rate lookup table implementation in accordance with the present invention.

Referring to FIG. 5, device 76 includes a lookup table 82 (LUT) established in memory 78. Lookup table 82 contains a plurality of throughput entries, e.g., 82-1, 82-2, 82-3, etc. A throughput pointer 84 contains a programmable pointer value, and is provided for selecting one of the plurality of throughput entries 82-1, 82-2, 82-3 as the throughput rate for print engine 24. For example, if the pointer value of throughput pointer 84 corresponds to entry 82-1, then a throughput rate for monochrome printing and color printing with print engine 24 is set to be 22 pages per minute (PPM) for monochrome and 15 PPM for color, respectively. In this example, entry 82-2 would set a throughput rate for monochrome printing and color printing with print engine 24 to be 20 PPM for monochrome and 14 PPM for color, respectively; and, entry 82-3 would set a throughput rate for monochrome printing and color printing with print engine 24 to be 18 PPM for monochrome and 12 PPM for color.

The programmable pointer value of throughput pointer 84, which may be stored for example in memory 28 of controller 22, may be initialed at the time of manufacture of imaging apparatus 14 to define an initial throughput capability of imaging apparatus 14. Later, a user may upgrade the throughput capabilities of imaging apparatus 14 through the purchase of an upgrade kit, which may include a pointer value that may select an increased throughput capability for imaging apparatus 14. Such an upgrade may be effected, for example, through a download of the pointer value from a secure database associated with an online Internet transaction.

Figure 6:
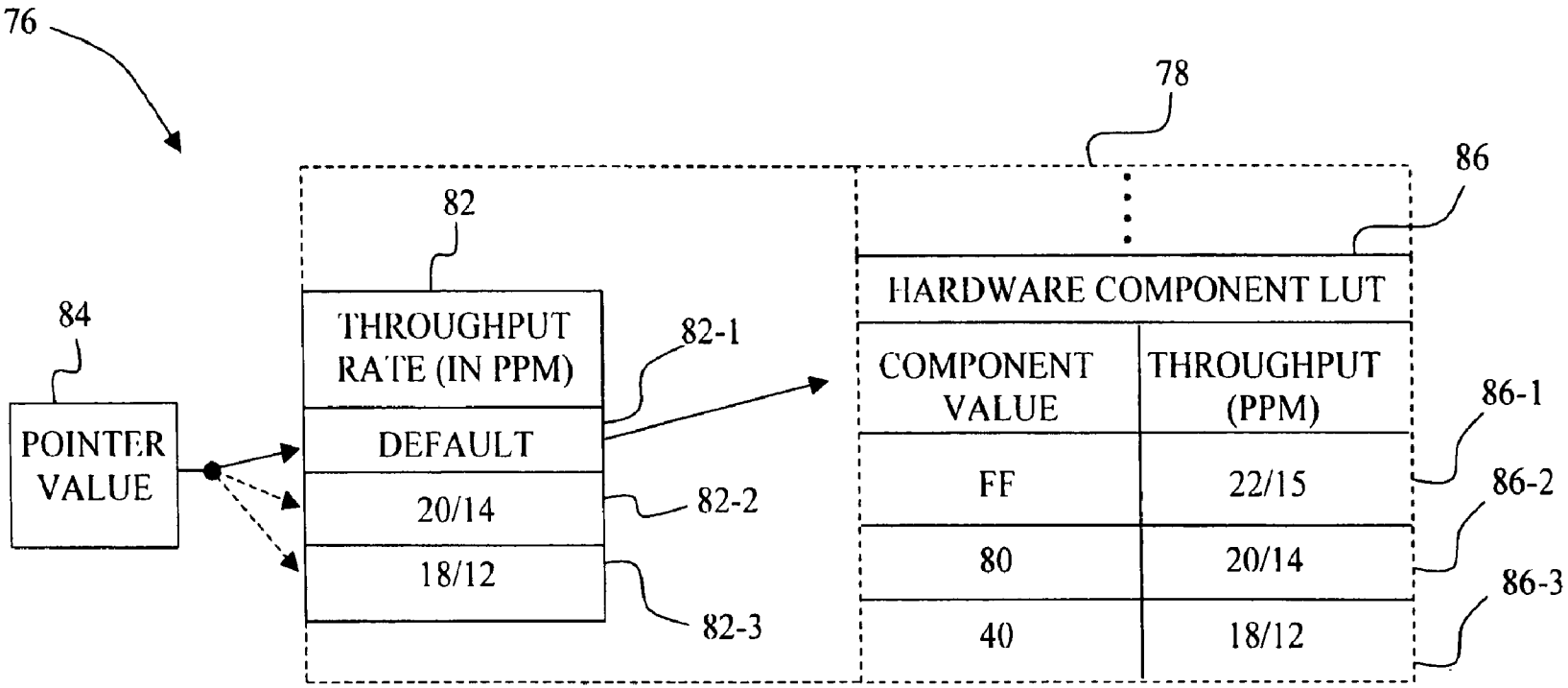
FIG. 6 is a diagrammatic representation of another exemplary threshold rate lookup table implementation in accordance with the present invention.

FIG. 6 is a variation of FIG. 5, and includes, in addition to lookup table 82, a second lookup table 86 (LUT) in memory 78 having entries, e.g., 86-1, 86-2, 86-3, etc., which are selectable based on a component value of hardware component 80 (see FIG. 1). The pointer value of throughput pointer 84 may be initially set to correspond to the default value of entry 82-1 of FIG. 6, or may be reprogrammed in the manner described above with respect to FIG. 5 to correspond to one of the other throughput entries, e.g., one of entries 82-2 and 82-3. In this example, entry 82-1 includes a default value, which redirects the selection to lookup table 86. In other words, the default value triggers controller 22 to check for a hardware indication of the throughput rate as established by hardware component 80 and lookup table 86. For example, if the pointer value of throughput pointer 84 is assigned an initial value that points to entry 82-1 in FIG. 6, then throughput pointer 84 points to a default entry of said plurality of throughput entries 82-1, 82-2, 82-3, which in turn points to lookup table 86. The replaceable hardware component 80 has a component value, such as for example, a resistance, that may be translated to an equivalent digital value, wherein a particular entry of the second plurality of throughput entries 86-1, 86-2, 86-3 is selected based on the component value of the replaceable hardware component 80. Replaceable hardware component 80 may be, for example, a bezel having a predefined resistance. Accordingly, the component value of replaceable hardware component 80 serves as an auxiliary throughput pointer.

For example, if the pointer value of throughput pointer 84 points to the default location 82-1 of FIG. 6, and hardware component 80 includes a resistance that corresponds to the digital value FF, then entry 86-1 is selected and the throughput rate selected for print engine 24 for monochrome printing and color printing with print engine 24 is set to be 22 pages per minute (PPM) for monochrome and 15 PPM for color, respectively. In this example, if hardware component 80 includes a resistance that corresponds to the digital value 80, then entry 86-2 would set a throughput rate for monochrome printing and color printing with print engine 24 to be 20 PPM for monochrome and 14 PPM for color, respectively. If hardware component 80 includes a resistance that corresponds to the digital value 40, then entry 86-3 would set a throughput rate for monochrome printing and color printing with print engine 24 to be 18 PPM for monochrome and 12 PPM for color.

Figure 7:
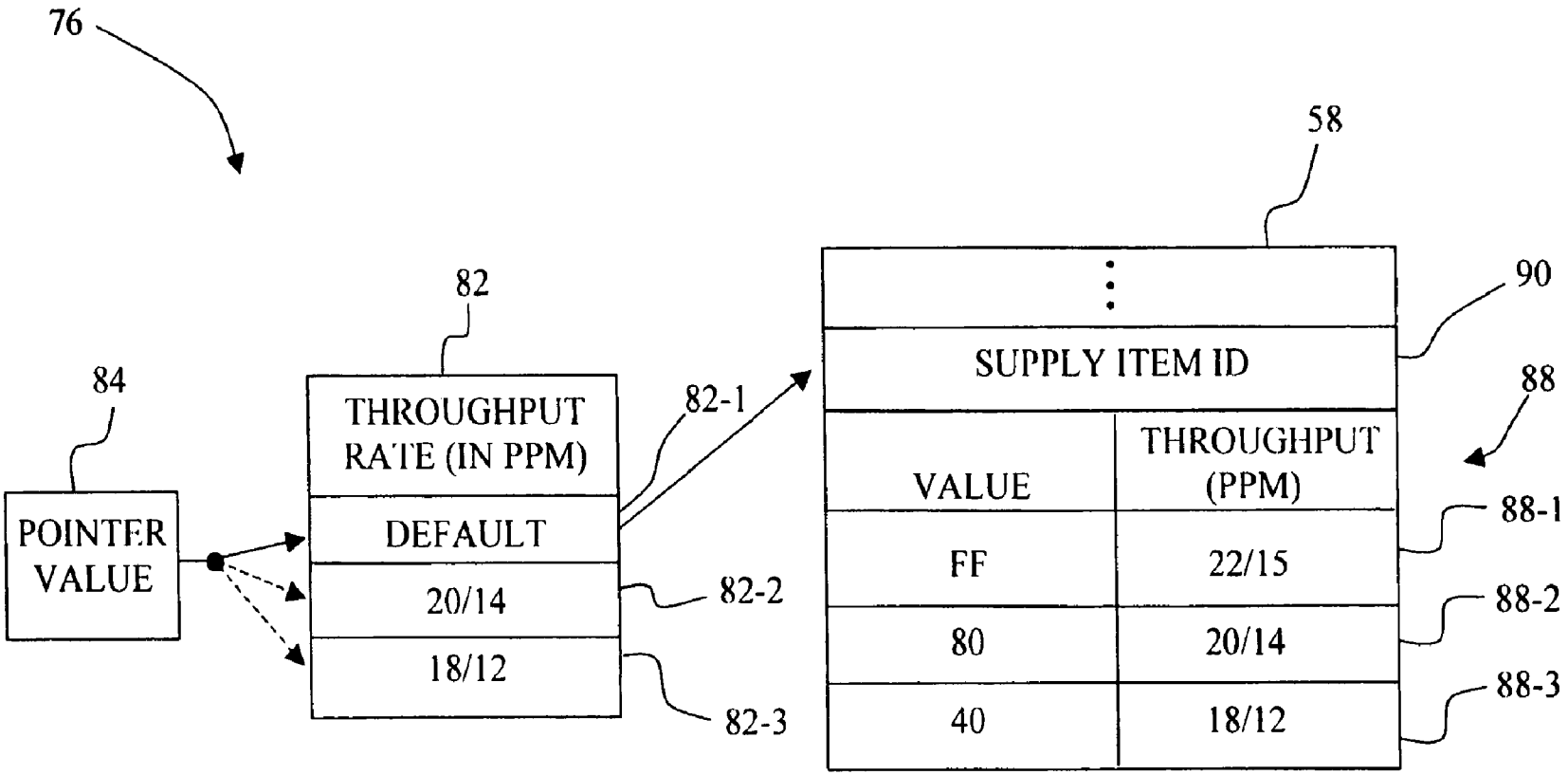
FIG. 7 is a diagrammatic representation of still another exemplary threshold rate lookup table implementation in accordance with the present invention.

FIG. 7 is a variation of FIG. 6, and includes, in addition to lookup table 82, a lookup table 88 (LUT) in memory 58 of supply item 34, having entries, e.g., 88-1, 88-2, 88-3, etc., which are selectable based on a pointer value of lookup table 88 in memory 58 of supply item 34. The pointer value of throughput pointer 84 may be initially set to correspond to the default value of entry 82-1 of FIG. 7, or may be reprogrammed in the manner described above with respect to FIG. 5 to correspond to one of the other throughput entries, e.g., one of entries 82-2 and 82-3. In this example, entry 82-1 includes a default value, which redirects the selection to lookup table 88 of memory 58. For example, if the pointer value of throughput pointer 84 is assigned an initial value that points to entry 82-1 in FIG. 7, then throughput pointer 84 points to a default entry (82-1) of the plurality of throughput entries 82-1, 82-2, 82-3, which in turn points to lookup table 88. Depending on the supply item identification value of identification entry 90 of memory 58, a particular entry of the plurality of throughput entries 88-1, 88-2, 88-3 is selected. Accordingly, the supply item identification value of identification entry 90 of memory 58 serves as an auxiliary throughput pointer.

For example, if the pointer value of throughput pointer 84 points to the default location 82-1 of FIG. 7, and the supply item identification value of identification entry 90 of memory 58 corresponds to the digital value FF, then entry 88-1 is selected and the throughput rate selected for print engine 24 for monochrome printing and color printing with print engine 24 is set to be 22 pages per minute (PPM) for monochrome and 15 PPM for color, respectively. In this example, if the supply item identification value of identification entry 90 of memory 58 corresponds to the digital value 80, then entry 88-2 would set a throughput rate for monochrome printing and color printing with print engine 24 to be 20 PPM for monochrome and 14 PPM for color, respectively. If the supply item identification value of identification entry 90 of memory 58 corresponds to the digital value 40, then entry 88-3 would set a throughput rate for monochrome printing and color printing with print engine 24 to be 18 PPM for monochrome and 12 PPM for color.

Thus, in this example, the throughput capabilities of imaging apparatus 14 may be tied to the particular supply item installed in imaging apparatus 14. As such, for example, a user may upgrade imaging apparatus 14 from a lower throughput capability to a higher throughput capability simply through the purchase of a supply item that designates in its identification value a higher throughput capability, such as that associated with entry 88-1 of FIG. 7.

More particularly, supply item 34 may be configured to program imaging apparatus 14 to operate at a specified throughput rate based on the type of supply item 34 that is installed in imaging apparatus 14. For example, supply item 34 may be one of a plurality of cartridge types, such as for example, one of a low-yield cartridge and a high yield cartridge; one of a low-resolution cartridge and a high resolution cartridge; or a cartridge having a predefined swath height ranging between a minimum swath height for the cartridge and a maximum swath height for the cartridge. For example, as a low-yield cartridge, supply item 34 may program imaging apparatus 14 to be used as a basic printer with a relatively low throughput rate. As a high yield cartridge, for example, supply item 34 may program imaging apparatus 14 to be used as a high speed printer, capable of a relatively high throughput rate.

Supply item 34 may be configured by setting a predefined bit, or bits, in memory 58 of electronic circuit 56 attached to supply item 34 according to the desired programming of imaging apparatus 14. Alternatively, all or a portion of a supply item identification number may be associated with a particular throughput rate. When supply item 34 is installed in imaging apparatus 14, then controller 22 may read, for example, memory 58 of electronic circuit 56 of supply item 34. In accordance with one aspect the present invention, controller 22 will then program imaging apparatus 14 such that print engine 24 operates in one of a plurality of throughput rates, based on information retrieved from memory 58 of electronic circuit 56 of supply item 34.

Figure 8:
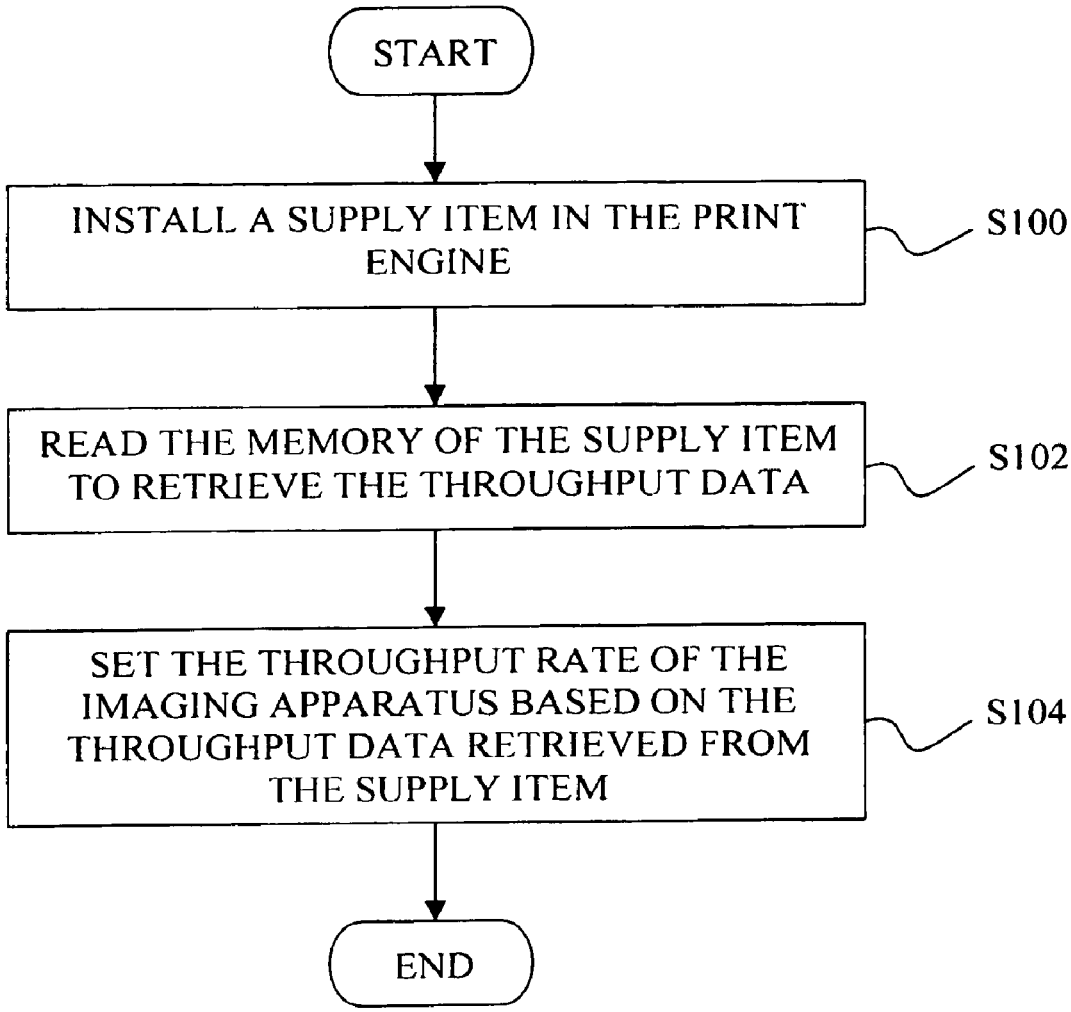
FIG. 8 a flowchart of an exemplary method of configuring an imaging apparatus, in accordance with one aspect of the present invention.

FIG. 8 is a flowchart of an exemplary method of configuring an imaging apparatus, in accordance with this aspect of the present invention.

At step S100, supply item 34 is installed in print engine 24. Supply item 34, such as for example, ink jet printhead cartridge 34*a* or 34*b*, includes memory 58 containing throughput data for setting a throughput rate of imaging apparatus 14. The throughput data may be, for example, predefined bits which define the throughput rate associated with the supply item, or may be all or a portion of the supply item identification number which is associated with a particular throughput rate.

At step S102, memory 58 of supply item 34 is read, e.g., by controller 22, to retrieve the throughput data stored in memory 58.

At step S104, the throughput rate of imaging apparatus 14 is set based on the throughput data retrieved from supply item 34.

This concept permits, for example, a user to be rewarded with an increased throughput rate upon the purchase of a particular model of supply item. Such a particular model of supply item may be, for example, a high yield cartridge having a supply of imaging substance, e.g., ink, for printing a high number of pages, such as for example, 5,000 pages at five percent coverage.

Alternatively, where supply item 34 is an ink jet printhead cartridge, e.g., 34*a* or 34*b*, a user may be rewarded with an increased throughput rate based on an amount of ink usage. For example, ink usage in ink jet printer 14-1 may be monitored in a manner well known in the art by counting the number of firings of the actuators associated with ink jetting nozzles 72. Once a particular ink usage threshold is reached, then the user may be rewarded with an increased throughput rate for ink jet printer 14-1.

In one embodiment, the throughput rate of imaging apparatus 14 may be set based on a selected swath height 74 for ink jet printhead cartridge 34*a* or 34*b* having a plurality of selectable ink jetting nozzles 72. As stated above, the swath height 74 of swath 70 (see FIG. 4) corresponds to the distance between the uppermost and lowermost of the available nozzles of printhead 60. Thus, to accommodate a particular throughput rate, the uppermost and lowermost of the nozzles of printhead 60 may be defined to be a subset of all potentially available ink jetting nozzles 72.

In another exemplary embodiment, the throughput rate may be set based on a selected delay time of a delay that is inserted between consecutive printing swaths 70. Alternatively, the throughput rate may be set based on a selected delay time of a delay that is inserted between printed pages. For example, based on the cost of supply item 34, the throughput rate may be set by inserting an appropriate delay or removing all delays.

In another exemplary embodiment, the throughput rate may be set based on a selected printing resolution for the ink jet printhead cartridge, e.g., ink jet printhead cartridge 34*a* or 34*b*. The ink jetting nozzles are vertically spaced at a predefined nozzle pitch. The printing resolution for the ink jet printhead cartridge may be selected by defining a subset of all potentially available ink jetting nozzles 72 for printing with the ink jet printhead cartridge. Alternatively, an interleave pattern between consecutive print swaths 70 may be changed to accommodate a particular printing resolution.

While this invention has been described with respect to embodiments of the invention, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus, comprising:

a print engine for printing on a print medium, said print engine having a defined initial throughput capability having a throughput rate;

a device communicatively coupled with said print engine, said device being programmed to upgrade said throughput capability to a new throughput rate for said print engine; and a controller for reading said device, said controller operating said print engine at said throughput rate designated by said device, wherein said device includes a lookup table established in a memory, said lookup table containing a plurality of throughput entries, and a throughput pointer for selecting one of said plurality of throughput entries as said throughput rate for said print engine.

2. The imaging apparatus of claim 1, wherein said throughput pointer has a value that is programmed to point to a particular entry of said plurality of throughput entries.

3. The imaging apparatus of claim 2, wherein said value is assigned an initial value that points to a default entry of said first plurality of throughput entries.

4. The imaging apparatus of claim 1, said imaging apparatus being communicatively coupled to a source for supplying a pointer value to said device for selecting said throughput rate.

5. The imaging apparatus of claim 4, wherein said source is a memory associated with a supply item.

6. The imaging apparatus of claim 4, wherein said source is a database.

7. The imaging apparatus of claim 4, wherein said source is a replaceable hardware component.

8. The imaging apparatus of claim 4, wherein said source is a memory of a printing cartridge.

9. The imaging apparatus of claim 8, wherein said printing cartridge is one of an ink jet printhead cartridge and an electrophotographic (EP) cartridge.

10. The imaging apparatus of claim 1, wherein a user upgrades said imaging apparatus by programming said device to effect said new throughput rate for said print engine.

11. The imaging apparatus of claim 1, wherein said device is initially programmed with a default value.

12. The imaging apparatus of claim 11, wherein said default value is overruled by a reprogramming of said device.

13. The imaging apparatus of claim 11, wherein said default value triggers said controller to check for a hardware indication of said throughput rate.

* * * * *